United States Patent [19]

Vossieck

[11] 4,346,684

[45] Aug. 31, 1982

[54] VALVE SEAT RING

[75] Inventor: Paul Vossieck, Burscheid, Fed. Rep. of Germany

[73] Assignee: Goetze AG, Burscheid, Fed. Rep. of Germany

[21] Appl. No.: 145,762

[22] Filed: Apr. 30, 1980

[30] Foreign Application Priority Data

May 5, 1979 [DE] Fed. Rep. of Germany ..... 2918248

[51] Int. Cl.[3] ..... F01L 3/02

[52] U.S. Cl. ..... 123/188 S; 29/156.7 A

[58] Field of Search ..... 123/188 S; 29/156.7 A

[56] References Cited

U.S. PATENT DOCUMENTS

| | | | |
|---|---|---|---|
| 2,100,620 | 11/1937 | Wirrer et al. | 123/188 S |
| 2,101,970 | 12/1937 | Wissler | 123/188 S |
| 2,296,460 | 9/1942 | McDonald | 123/188 S |
| 2,753,858 | 7/1956 | Honeyman et al. | 123/188 S |
| 2,753,859 | 7/1956 | Bartlett | 123/188 S |
| 3,428,035 | 2/1969 | Stefan et al. | 123/188 S |

FOREIGN PATENT DOCUMENTS 2139738 3/1974 Fed. Rep. of Germany .

*Primary Examiner*—Craig R. Feinberg
*Assistant Examiner*—W. R. Wolfe
*Attorney, Agent, or Firm*—Spencer & Kaye

[57] ABSTRACT

A sintered valve seat ring having excellent resistance to wear, to corrosion and to thermal stresses, and a method for its production. The ring comprises a supporting portion made up of an iron or steel alloy and a facing portion, subject to wear, of a cobalt and/or nickel alloy. The supporting portion comprises up to 30% by weight of the alloy of the facing portion.

10 Claims, 1 Drawing Figure

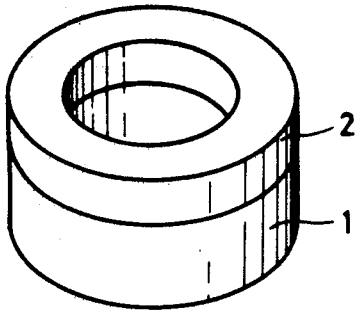
2
1

VALVE SEAT RING

BACKGROUND OF THE INVENTION

The present invention relates to a sintered valve seat ring for an internal-combustion engine.

In practice, valve seat rings for internal-combustion engines are made mainly of cast or sintered metal alloys. Due to their excellent resistance to wear, particularly to corrosion and to stresses caused by alternating temperatures during operation of the engine, metal alloys based on nickel or cobalt are primarily used. However, these metals are relatively expensive and their costs will rise with the increasing scarcity of the raw materials.

As a substitute, valve seat rings have been made of highly alloyed types of cast iron or sintered iron. However, such valve seat rings do not have the required high resistance to stresses during engine operation. For that reason, the seating faces of the rings are often protected by surface treatments. When an armor coating is applied by, for example, deposition welding, the adhesion of the coating on the ring must be particularly good since during operation of the engine the seating face is stressed by the impacts of the valve head, possibly causing the coating to chip off.

Other surface treatment processes, such as surface hardening with nitrides or borides, as is customary with other machine parts that are subject to friction, cannot be used with valve seat rings since the rings must be ground before being installed and such grinding would remove the relatively thin, hardened coatings.

Machine parts such as sealing strips or piston rings for internal-combustion engines, have been conventionally sintered with different sintering substances for the supporting portion and the facing portion (that is, the portion subject to wear). This method also presents the problem of providing particularly good adhesion between the portions, because of the high impact stresses imparted by the valve head during engine operation. To overcome this problem, German Pat. No. 2,139,738 discloses sealing strips or gaskets which are sintered of a mixture of a steel alloy powder and a carbide powder in such a way that the proportion of carbide in the supporting portion is considerably less than the proportion of carbide in the portion subject to wear. Since, however, the binder metal is the same in both cases, the machine part can be sintered in a single process step. Advantageously, however, at least the facing portion of valve seat rings should consist of nickel or cobalt alloys which are basically binder metals and which have a lower sintering temperature than steel.

SUMMARY OF THE INVENTION

It is an object of the present invention to provide a sintered valve seat ring of high strength which has the beneficial properties of sintered nickel or cobalt alloy, but which can be manufactured in a simple manner with low raw material costs.

This object and others to become apparent as the specification progresses, are achieved by the invention, according to which, briefly stated, the sintered valve seat ring for an internal-combustion engine comprises a supporting portion containing an iron alloy or steel alloy and a facing portion containing a cobalt alloy, a nickel alloy or an alloy of nickel and cobalt and further, the supporting portion comprises an amount up to 30% (but preferably only up to 10%) of its weight, of the alloy of the facing portion to enable the facing portion and the support portion to be compacted and sintered in a single process step.

BRIEF DESCRIPTION OF THE DRAWING

The sole drawing FIGURE is a perspective view of a valve seat ring according to a preferred embodiment of the present invention.

DETAILED DESCRIPTION OF THE INVENTION

The valve seat ring of the present invention comprises a supporting portion having, in superposed relationship therewith, a facing portion which contains the valve seating face proper and which is thus the ring component exposed to wear during the reciprocation of the associated valve head. In the drawing FIGURE, there is shown a valve seat ring according to the present invention, having a supporting portion 1 and a facing portion 2 superposed thereon.

The supporting portion contains a sintered low alloy of iron or steel of the types known to the art for fabrication of such machine parts. The preferably used alloy is a steel with 0.5 to 2.0% carbon
0.1 to 1.5% manganese
0.1 to 2.0% silicon
0 to 4.0% nickel
0 to 10% chromium
remainder iron with normal impurities.

The facing portion is a cobalt and/or nickel alloy. Preferably, this alloy is of one of the following compositions:

(1) 10 to 14% cobalt,
up to 1.5% carbon,
10 to 28% chromium,
3 to 14% tungsten and/or molybdenum,
1 to 2% copper,
up to 8% iron, and the
balance nickel.

(2) 10 to 14% nickel,
3 to 14% tungsten and/or molybdenum,
up to 1.25% carbon,
18 to 28% chromium,
2 to 4% copper,
up to 8% iron, and the
balance cobalt.

The supporting portion contains up to 30% by weight, but preferably only up to 10% by weight of the alloy used in the facing portion. The presence of this alloy in the supporting portion enables the valve seat ring to be sintered at the temperatures customary for sintering the facing portion which generally are lower than the temperatures for sintering steel. Thus, the valve seat ring may be pressed and sintered economically in a single process step.

Additionally, the supporting portion may comprise up to 5% by weight of elemental boron and/or silicon or a low melting point nickel and/or cobalt alloy. Preferably, this alloy comprises:

up to 1.25% carbon,
18 to 28% chromium,
10 to 14% tungsten and/or molybdenum, 1 to 4% boron,
1 to 4.5% silicon, and the
balance nickel and/or cobalt.

The small additions of boron and/or silicon will produce low melting point alloys with the supporting material which will melt during the sintering process so that a dense supporting portion with improved physical properties will result.

The facing portion may additionally comprise up to 30% by weight, but preferably only up to 10% by weight, of the alloy of the supporting portion.

Preferably, up to one third of the axially measured thickness of the valve seat ring is made up of the facing portion. The remainder, at least two-thirds of the thickness of the ring, is then made up of the supporting portion.

The valve seat ring produced according to the present invention exhibits excellent resistance to wear, corrosion and the alternating thermal stresses of engine operation, due to the presence of nickel and/or cobalt alloys in the facing portion. The presence of these nickel and/or cobalt alloys in the supporting portion enables the ring to be economically sintered in a single process step, at a lower temperature than customary for iron and steel sintering. Further, because the supporting portion and facing portion have components in common, a very firm bond is created between the portions which can resist the impact stresses exerted by the valve plate during engine operation.

In the process for forming the valve seat rings according to the invention, the iron or steel alloy powder mixture is added to the die, to at least about two thirds of its height. The cobalt and/or nickel alloy powder mixture is then added on top of the iron or steel alloy powder mixture. The powders in the die are compressed at a pressure of about 4 to 8.000 kg/cm$^2$. The powders are then sintered for a period of about 20 minutes to 2 hours at a temperature of about 1050° to 1250° C., to produce the valve seat ring.

EXAMPLE 1

A valve seat ring is fabricated from an iron alloy for the supporting portion and a nickel alloy for the facing portion.

The sintering alloy used for the facing portion is a nickel alloy containing 1% carbon, 11% cobalt, 7% molybdenum, 11% chromium, 1.5% copper, 4% iron and the remainder nickel.

For the sintering alloy of the supporting portion, 90 parts of an iron alloy containing 1.8% carbon, 0.8% manganese, 1% silicon, 3% nickel, 8% chromium, and the remainder iron, are mixed with 10 parts of the sintering alloy of the facing portion. Both sintering alloys are filled into a pressing mold in two superposed layers in such a way that the height (thickness) of the uppermost layer, which is the facing portion, is about one third of the total ring height (thickness). Thereafter, the mixture is compressed at a pressure of 1500 kg/cm$^2$ and sintered for four hours at 1250° C. which is the sintering temperature of the alloy of the facing portion.

The resulting valve seat ring exhibits a very firm bond between the facing portion and the supporting portion and in engine tests was found to have excellent stability.

EXAMPLE 2

To 90 parts by weight of the alloy used in the facing portion in Example 1, there are added 10 parts by weight of the alloy used in the supporting portion of Example 1. This mixture is used as the facing portion. The supporting portion is the same as in Example 1. The subsequent pressing and sintering takes place under the same conditions as in Example 1.

EXAMPLE 3

To 85 parts by weight of the alloy for the supporting portion according to Example 1 there are mixed 10 parts by weight of the alloy for the facing portion, 1.5 parts silicon and 3.5 parts boron. The alloy of Example 2 is used as the alloy for the facing portion. The subsequent pressing and sintering takes place under the same conditions as in Example 1.

EXAMPLE 4

85 parts by weight of the alloy powder for the supporting portion of Example 1 are mixed with 10 parts by weight of the alloy for the facing portion and 5 parts of a low-melting point alloy containing 1% carbon, 22% chromium, 11% tungsten, 3% boron, 4% silicon and the remainder nickel. The alloy for the facing portion is the alloy of Example 2. Pressing and sintering take place as in Example 1.

It will be understood that the above description of the present invention is susceptible to various modifications, changes and adaptations, and the same are intended to be comprehended within the meaning and range of equivalents of the appended claims.

What is claimed is:

1. In a sintered valve seat ring including an annular supporting portion and an annular facing portion superposed on the supporting portion; said supporting portion comprising a material selected from the group consisting of an iron alloy and a steel alloy and said facing portion comprising a material selected from the group consisting of a nickel alloy, a cobalt alloy and a nickel-cobalt alloy; the improvement wherein said supporting portion additionally comprises, distributed therein, up to 30% by weight of the alloy selected for said facing portion.

2. A valve seat ring as defined in claim 1, wherein the supporting portion comprises up to 10% by weight of the alloy of the facing portion.

3. A valve seat ring as defined in claim 1, wherein the alloy of the facing portion comprises 10% to 14% cobalt, a maximum of 1.5% carbon, 10% to 28% chromium, 3% to 14% at least one of the materials selected from the group consisting of tungsten and molybdenum, 1% to 2% copper, up to 8% iron and the balance nickel.

4. A valve seat ring as defined in claim 1, wherein the alloy of the facing portion comprises 10% to 14% nickel, a maximum of 1.25% carbon, 3% to 14% at least one of the materials selected from the group consisting of tungsten and molybdenum, 18% to 28% chromium, 2% to 4% copper, up to 8% iron and the balance cobalt.

5. A valve seat ring as defined in claim 1, wherein the alloy of the supporting portion comprises up to 5% at least one of the materials selected from the group consisting of elemental boron and silicon.

6. A valve seat ring as defined in claim 1, wherein the axially measured thickness of the facing portion is about one-third of the axially measured thickness of the valve seat ring.

7. A valve seat ring as defined in claim 1, wherein the facing portion additionally comprises, distributed therein, up to 30% of the alloy selected for the supporting portion.

8. A valve seat ring as defined in claim 7, wherein the facing portion comprises up to 10% of the alloy selected for the supporting portion.

9. A valve seat ring as defined in claim 1, wherein the alloy of the supporting portion comprises up to 5% by weight of a low melting point alloy.

10. A valve seat ring as defined in claim 9, wherein said low melting point alloy comprises up to 1.25% carbon, 18% to 28% chromium, 10% to 14% at least one of the materials selected from the group consisting of tungsten and molybdenum, 1% to 4% boron, 1% to 4.5% silicon and the balance at least one of the materials selected from the group consisting of nickel and cobalt.

* * * * *